US008813823B2

(12) United States Patent
Zhu et al.

(10) Patent No.: US 8,813,823 B2
(45) Date of Patent: Aug. 26, 2014

(54) ANNULAR CLEAN METAL CASTING MOLD

(75) Inventors: Shucheng Zhu, Henan (CN); Xibin Wang, Henan (CN); Guochao Cao, Henan (CN)

(73) Assignee: Xixia Dragon Into Special Material Co., Ltd. (CN)

( * ) Notice: Subject to any disclaimer, the term of this patent is extended or adjusted under 35 U.S.C. 154(b) by 0 days.

(21) Appl. No.: 13/881,890

(22) PCT Filed: Nov. 24, 2010

(86) PCT No.: PCT/CN2010/079037

§ 371 (c)(1), (2), (4) Date: Jun. 28, 2013

(87) PCT Pub. No.: WO2012/055128

PCT Pub. Date: May 3, 2012

(65) Prior Publication Data

US 2013/0269904 A1 Oct. 17, 2013

(30) Foreign Application Priority Data

Oct. 26, 2010 (CN) ..... 2010 1 0527822

(51) Int. Cl.
*B22C 9/06* (2006.01)
*B22D 27/04* (2006.01)

(52) U.S. Cl.
CPC . *B22C 9/06* (2013.01); *B22C 9/065* (2013.01); *B22D 27/04* (2013.01)
USPC ..... 164/348; 164/126; 164/128

(58) Field of Classification Search
CPC ..... B22C 9/06; B22C 9/065; B22D 27/04; B22D 7/04
USPC ..... 164/122, 122.1, 125–128, 348, 421, 164/464
See application file for complete search history.

(56) References Cited

U.S. PATENT DOCUMENTS 4,729,419 A * 3/1988 Nakamura et al. ..... 164/302
4,759,399 A * 7/1988 Saito et al. ..... 164/126
6,719,034 B2 * 4/2004 Heck et al. ..... 164/103

FOREIGN PATENT DOCUMENTS

CN 2173671 Y 8/1994
CN 1853826 A 11/2006

(Continued)

OTHER PUBLICATIONS

EPO machine translation of SU 839681, Jun. 23, 1981.*

(Continued)

*Primary Examiner* — Kevin E Yoon
(74) *Attorney, Agent, or Firm* — Rossi, Kimms & McDowell LLP

(57) ABSTRACT

An annular clean metal casting mold has a mold body which includes a cold bottom mold plate and a peripheral cold mold plate in connection with the cold bottom mold plate. An annular hot preservation layer is disposed inside the peripheral cold mold plate. A cyclic clean crystalline region is formed between the peripheral cold mold plate and the annular hot preservation layer. A sacrificial crystalline region is formed inside the cyclic hot preservation layer. As the outer race of the annular clean crystallization zone contacts large area of the peripheral low cold mold plate, releasing heat rapidly, while the inner race contacts the annular hot preservation layer 3, heat dissipation is extremely slow, naturally result in forming orientational crystallization. The vast majority of impurities and segregations in the liquid metal are gathered at the portion contacting with the annular hot preservation layer, and thus after the liquid metal is solidified, the gathered impurities and segregations can be removed easily, to obtain a clean casting ingot.

4 Claims, 2 Drawing Sheets

(56) References Cited

FOREIGN PATENT DOCUMENTS

| | | | |
|---|---|---|---|
| CN | 101406938 | A | 4/2009 |
| SU | 839681 | A1 | 6/1981 |
| WO | 87/04376 | A1 | 7/1987 |

OTHER PUBLICATIONS

International Search Report for PCT/JP2010/079037, dated Jul. 21, 2011.

* cited by examiner

ANNULAR CLEAN METAL CASTING MOLD

This application is a U. S. National Phase Application of PCT International Application PCT/CN2010/079037, filed on Nov. 24, 2010, which is based on and claims priority from CN 201010527822.7, filed on Oct. 26, 2010, the contents of which is incorporated in its entirety by reference.

TECHNICAL FIELD

The present invention relates to an annular clean metal casting mold which belongs to the field of metallurgical casting equipment technology.

BACKGROUND OF THE INVENTION

It is well known in the art that in the upper off-center position of the ingot casted by ordinary casting mold, there exists a V-shape area enriching of segregates and inclusions. The segregates and inclusions in this area are hard to be removed because of being located in the upper central portion. In this case, it leads to two possibilities: one is to ensure the quality of the metal by sacrificing more than half of the metal yield; the other one is to ensure certain metal yield by lowering its quality. However, both of the two possibilities are not what desired.

Currently, most of metal ingots in the world are still casted in this way, and thus a lot of metal cannot be got with a high quality and cannot to be used effectively and fully, which cause much energy wasting.

And in order to get clean metal, a secondary melting refining procedure, such as electroslag remelting is needed. This causes a great wasting of manpower and resource. Additionally, a great pressure is also imposed on the environment.

This does not meet the development requirements of energy saving and environmental protection, which is the great loss of the metal smelting industry.

In addition, because the efficiency is particularly low, especially the electric arc could seriously damage the crystallizer, a crystallizer mold in the manner of electroslag furnace remelting can only refine scores of furnace of steel, which increases the cost of production.

In practice, many customers need large metal pieces having an annular, tubular or sleeve shape, and the products are mostly produced by forging punching. However, if the desired product needs a larger hole, more time and energy will be required for punching and reaming, which leads to the increasing of production cost.

SUMMARY OF THE INVENTION

The present invention provides an annular clean metal casting mold with a long service life, which can reduce emissions of pollutants and improve production efficiency. The product obtained by this kind of mold has a good quality of metal crystals in one direction with fewer inclusions and do not need to be punched. What is more, it can be used for post-processing of the annular, tubular or sleeve-shaped large workpiece having a large opening, which could save energy and improve efficiency.

The annular clean metal casting mold includes a casting mold body with an ingate and a heat preservation dead head arranged on the casting mold body. The casting mold body includes a cold bottom mold plate and a peripheral cold mold plate in connection with the cold bottom mold plate. An annular high heat preservation layer is disposed inside the peripheral cold mold plate. A cyclic clean crystalline region is formed between the peripheral cold mold plate and the annular hot preservation layer. A sacrificial crystalline region is formed inside the cyclic hot preservation layer.

The cold bottom mold plate is a water-cooled mold plate.

The peripheral cold mold plate is a water-cooled mold plate.

The annular hot preservation layer includes the skeleton and the heat preservation material outside the skeleton.

Since an annular hot preservation layer is set in the peripheral cold mold plate in the present invention, the crystalline region is divided into annular clean crystalline zone and sacrificial crystallization zone in the center As for the annular clean crystallization zone, its outer race contacts the large area of the peripheral cold mold plate, releasing heat rapidly; and the inner race contacts the annular hot preservation layer. As the heat dissipation of sacrificial crystallization zone in the annular hot preservation layer is extremely slow, the inner race presents a high temperature in its vicinity, which naturally results in forming orientational crystallization of the liquid metal from the outer race towards the inner race. During the process of crystallization, the inclusions and segregates in the liquid metal will be driven to the direction of annular hot preservation layer, and the liquid metal near the annular hot preservation layer solidifies at last because of being away from low temperature, and most of the inclusions and segregates in the liquid metal are enriched at the portion in contacts with the annular hot preservation layer. In this way, it will be very easy to use flame or other processing methods to remove the enriched inclusions and segregates, so as to achieve the purpose of removing and transferring the inclusions and segregation in the ingot mold and getting purification ingot.

Liquid metal in the sacrificial crystallization zone solidifies at last, which plays a role to prevent the annular hot preservation layer from being damaged by the tremendous stress generated during the liquid metal solidification process in the annular clean crystalline zone, ensuring the force balance between the inside and outside of the annular hot preservation layer. Meanwhile, the sacrificial crystallization zone 6 guarantees hot preservation layer at a hot state, allowing the solidification of annular part metal to present a more orientational solidification characteristic. After the solidification is completed, the annular metal ingot is formed by pulling out the metal pillar. And then, a clean annular, tubular, sleeve-shaped mold will be obtained after the segregates and inclusions near the inner surface of the mold are removed.

BRIEF DESCRIPTION OF THE DRAWINGS

In the following, the present invention will be further described in conjunction with the accompanying drawings.

DETAILED DESCRIPTION OF THE INVENTION

Embodiment 1

Figure 1:
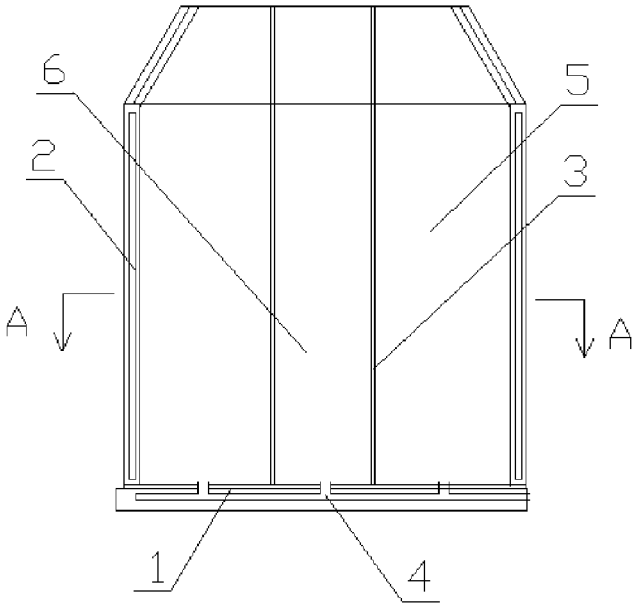
FIG. 1 is a schematic diagram according to a first embodiment of the present invention.
Figure 2:
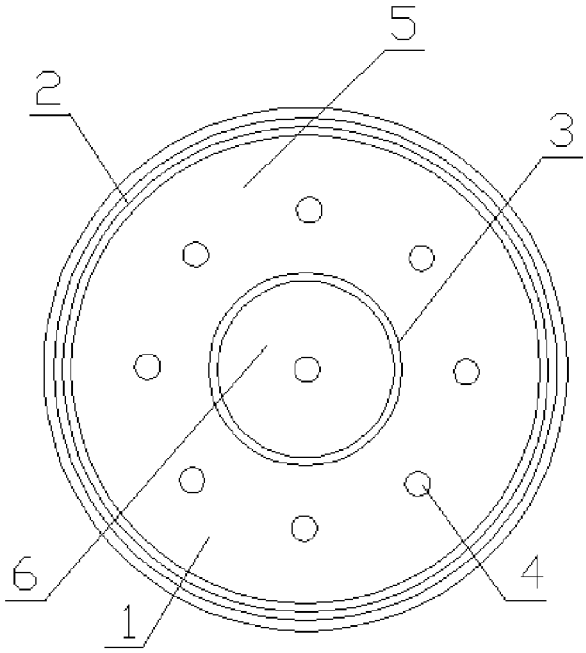
FIG. 2 is a sectional view of the FIG. 1 in the direction of AA.

As shown in FIGS. 1 and 2, the annular clean metal casting mold includes a casting mold body with an ingate 4 and a heat preservation dead head arranged on the ingot mold body. The mold body have a cylindrical shape.

The casting mold body includes a cold bottom mold plate 1 and the peripheral cold mold plate 2 in connection with the cold bottom mold plate 1. An annular hot preservation layer 3 is disposed inside the peripheral cold mold plate 2. A cyclic clean crystalline region 5 is formed between the peripheral cold mold plate 2 and the annular hot preservation layer 3. The sacrificial crystalline region 6 is formed inside the cyclic hot preservation layer 3.

The cold bottom mold plate 1 is a water-cooled mold plate.

The peripheral cold mold plate 2 is a water-cooled mold plate.

The annular hot preservation layer 3 includes the skeleton and the heat preservation material outside the skeleton, Embodiment 2

Figure 3:
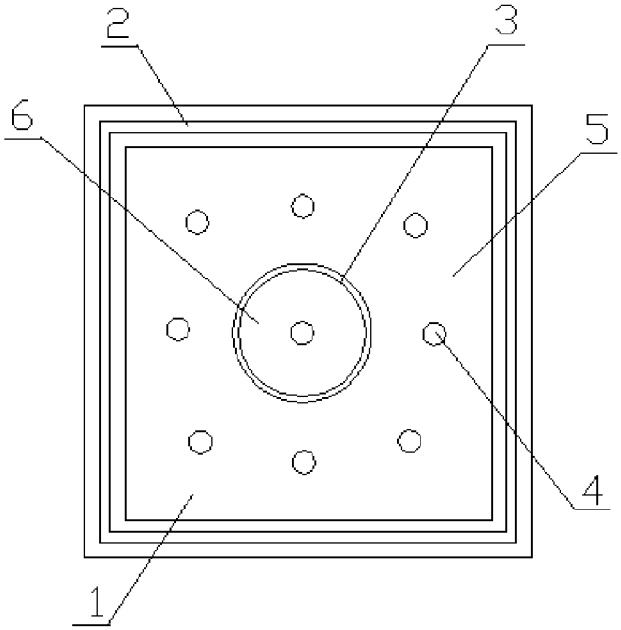
FIG. 3 is a schematic diagram according to a second embodiment of the present invention.

As shown in FIG. 3, the annular clean metal casting mold includes a casting mold body with an ingate 4 and a heat preservation dead head arranged on the ingot mold body.

The mold body has a cubic shape. The casting mold body includes the cold bottom mold plate 1 and the peripheral cold mold plate 2 in connection with the cold bottom mold plate 1. An annular hot preservation layer 3 is disposed inside the peripheral cold mold plate 2. A cyclic clean crystalline region 5 is formed between the peripheral cold mold plate 2 and the annular hot preservation layer 3. The sacrificial crystalline region 6 is formed inside the cyclic hot preservation layer 3.

The cold bottom mold plate 1 is a water-cooled mold plate.

The peripheral cold mold plate 2 is a water-cooled mold plate.

The annular hot preservation layer 3 includes the skeleton and the heat preservation material outside the skeleton.

Figure 4:
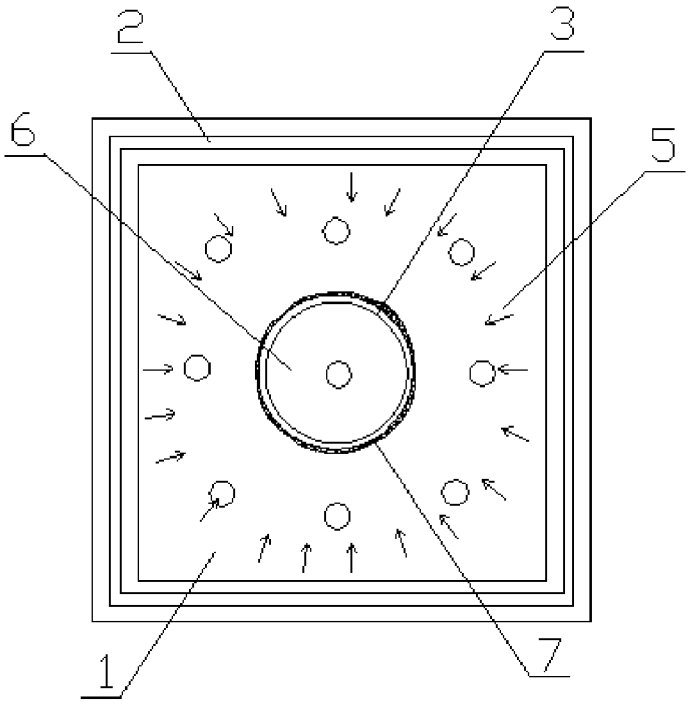
FIG. 4 is a schematic diagram of the crystalline direction of the second embodiment of the present invention.

As shown in FIG. 4, an annular hot preservation layer 3 is disposed inside the peripherial low cold mold plate 2, which divide the crystalline region into an annular clean crystalline zone 5 and a sacrificial crystallization zone 6 in the center.

As for the annular clean crystallization zone 5, its outer race contacts large area of the peripheral low cooling mold plate 2, releasing heat rapidly; the inner race contacts the annular hot preservation layer 3. As the heat dissipation of sacrificial crystallization zone 6 in the annular hot preservation layer is extremely slow, the inner race presents a high temperature in its vicinity, which naturally results in forming orientational crystallization of the liquid metal from the outer race to the inner race. During the process of crystallization, the inclusions and segregates in the liquid metal will be driven towards the direction of annular hot preservation layer 3, and most of the inclusions and segregates are enriched at the portion in contacts with the annular hot preservation layer, forming an impurity zone 7. In this way, it will be very easy to use flame or other processing methods to remove the enriched inclusions and segregates, so as to achieve the purpose of removing and transferring the inclusions and segregation in the ingot mold and getting purification ingot.

Liquid metal in the sacrificial crystallization zone 6 finally solidifies, which plays a role to prevent the annular hot preservation layer from being damaged by the tremendous stress generated during the liquid metal solidification process in the annular clean crystalline zone, ensuring the force balance between inside and outside the annular hot preservation layer. Meanwhile, the sacrificial crystallization zone 6 guarantees hot preservation layer at a hot state, making the solidification of annular part metal present more orientational solidification characteristic. After solidification finishes, the annular metal ingot forms with the metal pillar pulled out. And then the impurity zone 7 consisting of alloy segregates, inclusions near the inner surface is removed, and clean annular, tubular shell-like billets will be obtained. The direction indicated by the arrow in the figure is the direction of orientational crystallization.

What is claimed is:

1. An annular clean metal casting mold including a casting mold body with an ingate and a heat preservation dead head arranged on the casting mold body, wherein the casting mold body includes a cold bottom mold plate and a peripheral cold mold plate in connection with the cold bottom mold plate, an annular hot preservation layer is disposed inside the peripheral cold mold plate, a cyclic clean crystalline region is formed between the peripheral cold mold plate and the annular hot preservation layer, and a sacrificial crystalline region is formed inside the annular hot preservation layer.

2. An annular clean metal casting mold of claim 1, wherein the cold bottom mold plate is a water-cooled mold plate.

3. An annular clean metal casting mold of claim 1, wherein the peripheral cold mold plate is a water-cooled mold plate.

4. An annular clean metal casting mold of claim 2, wherein the peripheral cold mold plate is a water-cooled mold plate.

* * * * *